United States Patent [19]

Holloway

[11] 3,969,732

[45] July 13, 1976

[54] SPIRAL ANTENNA CIRCUIT

[76] Inventor: Albert L. Holloway, 941 Jackling Drive, Hillsborough, Calif. 94010

[22] Filed: Apr. 24, 1975

[21] Appl. No.: 571,423

[52] U.S. Cl. ..... 343/895
[51] Int. Cl.[2] ..... H01Q 1/36
[58] Field of Search ..... 343/895

[56] References Cited

UNITED STATES PATENTS

| | | | |
|---|---|---|---|
| 3,656,168 | 4/1972 | Stropki | 343/895 |
| 3,717,877 | 2/1973 | Hanninen et al. | 343/895 |
| 3,781,898 | 12/1973 | Holloway | 343/895 |
| 3,787,871 | 1/1974 | Reese | 343/895 |

*Primary Examiner*—Eli Lieberman
*Attorney, Agent, or Firm*—Richard Esty Peterson

[57] ABSTRACT

A spiral antenna circuit having as a principal active element a continuously scaled logarithmic spiral circuit originating substantially from a center point to a point of coupling with a matching continuous inverse logarithmic spiral circuit terminating at a predetermined incremental radius from the center point.

8 Claims, 4 Drawing Figures

SPIRAL ANTENNA CIRCUIT

BACKGROUND OF THE INVENTION

This invention relates to antenna circuits, particularly spiral antenna circuits which can be comparatively small in size, highly directional and substantially circularly polarized. Such antennas are used frequently, for example, in aircraft for direction finding or warning systems. The basic spiral antenna circuit is well known in the art and can be used in a variety of other systems not necessarily in the small highly directional systems described in U.S. Pat. No. 3,781,898, entitled, "Spiral Antenna with Dielectric Cover", issued Dec. 25, 1973, to this inventor. The antenna circuit of this invention can be applied wherever antenna circuits of a spiral nature are desired, which range in size from thumb size to several feet in diameter.

Archimedian spiral circuits have been useful in many spiral antenna systems. In a two arm spiral circuit having Archimedian spiral, two Archimedian circuit elements originate from adjacent to a center point, 180° out of phase, to a termination some given radius from the center point. The lack of uniformity in frequency response inherent in an Archimedian spiral pattern led to the development of the continuously scaled or logarithmic circuit.

In a two arm logarithmic spiral circuit, two circuit elements originate 180° out of phase from adjacent to a center point and follow a logarithmic path to a termination some given radius from the center point. The logarithmic spiral theoretically has a uniform frequency response at all frequencies. In practice, or select bandwiths, the response is remarkably uniform. However, the effective bandwith is limited by size considerations. Theoretically, a logarithmic spiral should originate at a center point and continue indefinitely for actual frequency independence. Truncating the spiral at some predetermined radius from a given center point limits the frequency independence of the circuit, since the developing lower frequencies are abruptly cut. In practice, abrupt truncation of a spiral causes severe distortions, or truncation effects, in the response characteristics of a spiral antenna due to reflections from the truncated end of the log spiral. Ellipticity in the antenna polarization performance, resulting from undesirable reflections from the truncated spiral, render the antenna unsuitable for high performance requirements of beamwidth uniformity with minimized polarization sensitivity in angular orientations. Other undesirable results from truncating, such as localized thermal energy buildup, are to be avoided.

A logarithmic spiral must, therefore, be effectively terminated and terminated within a reasonable incremental radius. Since the logarithmic spiral is growing exponentially, this latter requirement is of some substance.

One accepted method devised by this inventor and presently in practice, is to transform the expanding logarithmic spiral into a tightly wound Archimedian spiral, thereby allowing a substantial number of turns to be made within a given, small, radial increment allowed for the termination from the coupled end of the logarithmic spiral to the end of the Archimedian spiral. However, the juncture of transformation from the logarithmic spiral to the Archimedian spiral, even though graduated, creates a width and wrap angle discontinuity resulting in an impedence mismatch. This causes distortions, and in particular, an ellipticity at the lower frequencies from a tightly wound terminating spiral. This ellipticity is particularly pronounced as emissions are measured off the central perpendicular axis of a planar radial spiral. In addition, the Archimedian spiral is inherently not uniformly frequency responsive. These and other problems of sensitivity and symmetry led to the conceptualization and development of the antenna pattern of this invention.

SUMMARY OF THE INVENTION

The antenna circuit of this invention utilizes the desirable features of a continuously scaled logarithmic spiral for a spiral antenna circuit and couples such spiral to a continuously scaled inverse logarithmic spiral. This match provides a gradual continuum transformation from the principal active portion of the circuit to its eventual termination.

Because of the inherent symmetry and impedence match, a substantially improved equiangular response is achieved. Ellipticity at the lower frequencies is substantially reduced. Further, this coupling decreases radiation resistance and minimizes losses, such as copper and dielectric losses which contribute to distortion. Furthermore, the important objective of reducing the radial increment necessary for termination and thereby reducing the overall size of the antenna, is achieved.

Once the fundamental concept is understood, certain variations in the application of the concept become apparent. For example, the number of spiral arms or elements may be increased. In such instance, the elements spiral 360/n° out of phase from adjacent to the center point where $n$ is the number of elements. Each of the elements has a circuit termination comprising a continuously scaled inverse logarithmic spiral element.

Also, in designing a conventional logarithmic pattern for certain applications, it is possible at some radius from a center point to continue at a different selected wrap angle in developing the ultimate spiral. The wrap angle, which will be described in greater detail hereafter, is the angle made by a radial line to a locus point on the developing logarithmic curve and a tangent line to the curve at that point. It is a selected angular constant in the basic logarithmic formula: $R = R_o \exp[(\cot\alpha)\phi]$; where R is the radial line from the center point to a point on the developing logarithmic curve; $R_o$ is a selected starting radius from the center point, utilized since it is realistically impossible to begin the logarithmic pattern at the center point for a spiral circuit with two separate developing spiral element arms; $\alpha$ is the wrap angle; and, $\phi$ is the angular displacement from a starting reference line, i.e, the line through the center point and $R_o$. The wrap angle essentially controls the "tightness" of the developing pattern, that is, the number of turns made in a given radial increment. As $\phi$ approaches 90°, the number of turns increases in a given pattern. Loose spirals therefore have a lower wrap angle than tight spirals. Therefore, in certain circumstances one might select a low wrap angle to begin a logarithmic spiral and as the spiral, by the nature of the logarithmic curve, loosens as the distance from the center point increases, shift to a second selected wrap angle to tighten up the developing spiral. This may be done repeatedly depending on design considerations. Just as this is done for the logarithmic spiral, this may similarly be done for the inverse logarithmic spiral.

The basic inverse logarithmic formula is $R = R_n - R_o \exp[-(\cot\alpha)\phi]$; where R is the radial line from the center point of the pattern to a locus point on the developing inverse logarithmic curve; $R_n$ is a theoretical terminating radius from the center point; $R_o$ is a selected radial segment from the terminating radius to an actual terminating radius used to start the developing inverse logarithmic curve, again required for practical considerations in fabricating a working spiral. Again for design purposes, at some point the selected wrap angle $\alpha$ may be changed. For example, at the juncture of the connected logarithmic spiral with the inverse logarithmic spiral it may be desirable to adopt the same wrap angle for the inverse spiral as the basic spiral and then shift to a lower or higher wrap angle at some further point from the center point. This, as noted, may be done repeatedly to achieve certain desired results in either the response of an antenna or for facilitating fabrication of the antenna and is not intended to depart from the teachings of this disclosure.

DETAILED DESCRIPTION OF THE PREFERRED EMBODIMENT

Figure 1:
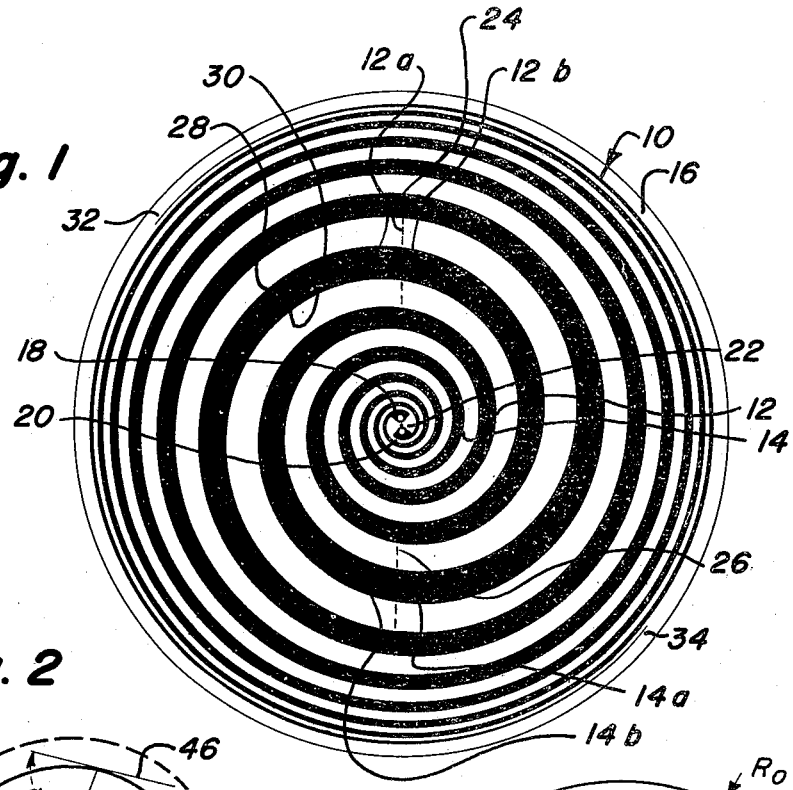
FIG. 1 is a plan view of a spiral antenna circuit constructed in accordance with this invention.

Referring to FIG. 1, a spiral antenna circuit 10 constructed in accordance with this invention is shown. The antenna circuit is formed of a first antenna element 12 and a second antenna element 14. The elements are fabricated from a copper overlay on a thin dielectric support blank 16. The first and second elements, 12 and 14, spiral from first and second terminals, 18 and 20, respectively, to which the terminating leads of a balun circuit (not shown) are electrically connected. The first and second terminals, 18 and 20, are oppositely arranged proximate to a center point 22 for the two arm spiral circuit.

The two elements, 12 and 14, spiral in two identical, but oppositely developing, continuously scaled logarithmic spirals, 12*a* and 14*a*, to oppositely situated junctures indicated by the dotted sectional lines 24 and 26. at the juncture lines 24 and 26, the logarithmic spirals are coupled to identical continuously scaled inverse logarithmic spirals, 12*b* and 14*b*. The inverse logarithmic spirals provide an in continuum extension of the first antenna element 12 and the second antenna element 14. Since the transition is virtually indetectable, the dotted lines 24 and 26 are included to schematically illustrate the juncture of the two spirals forming the overall antenna circuit.

The width of the two elements is determined by an advance or lag angle $\delta$ between the logarithmic edge lines 28 and 30 of each element. As a natural consequence the width of each element increases in the logarithmic spiral as the radial distance from the center point increases, and decreases in the inverse logarithmic spiral until the terminating radial distance is reached. As a further natural consequence, the gradual loosening of the logarithmic spiral is gradually tightened in the terminating inverse spiral thereby allowing an increasing number of turns to be made as the inverse spiral moves radially outward. This allows the termination of the circuit elements in the inverse spiral to gradually choke the lower frequency emission signals over an extended length of the elements with a substantially uniform loss rate over the inverse logarithmic termination spiral. By the time that the ends, 32 and 34, of the inverse logarithmic spirals are reached, the emission signals are so diminished that reflections from the ends of the elements are virtually nonexistent.

Figure 2:
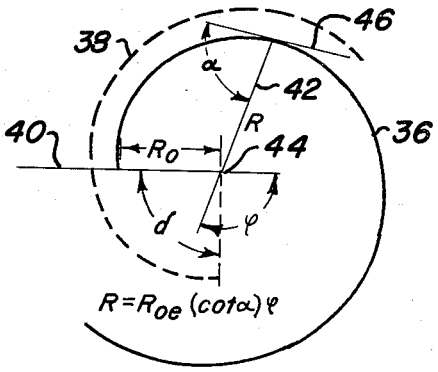
FIG. 2 is a schematic diagram of a logarithmic curve.

Referring now to FIG. 2, a diagram of a logarithmic curve is shown to illustrate schematically the parameters of the basic logarithmic equation: $R = R_o \exp[-(\cot\alpha)\phi]$ utilized in constructing the logarithmic portion of the antenna circuit 10 of FIG. 1. In FIG. 2, one edge line 36 of one of the antenna elements is shown. The other edge line 38 is shown in dotted line, since this curved edge line is constructed in an identical manner, but commencing from a lag angle $\delta$ from a reference starting line 40 for the edge line 36. R is a radial distance line 42 from a spiral antenna circuit center point 44 to a locus point on the logarithmic curve edge line 36 as defined by the equation above. $R_o$ is a starting displacement from the center point for the curve which is required in order to fabricate the antenna circuit with two separate terminals proximate to and on opposite sides of the center point 44. $\alpha$ is the wrap angle which is a predetermined select value regulating the looseness or tightness of the curve as desired for specific antenna designs and is formed by the radial distance line 42 and a tangent line 46 to a locus point on the curved edge line 36. $\alpha$ is maintained constant unless as discussed in the summary, the looseness or tightness in the pattern is desired to be changed at some select radius from the center point. Change of the $\alpha$ will then change the character of the curve in this respect. For simplicity in describing this invention, the $\alpha$ in the antenna circuit of FIG. 1 is a constant value in both the logarithmic spiral and the coupled inverse logarithmic spiral. $\phi$ is the angle from the reference line 40 to the radial distance line 42, at a particular locus point on the curved edge line 36. By selecting an $\phi$ and $R_o$ one side edge of an antenna element can be developed to the ultimate size of the active circuit pattern desired. By selecting a $\delta$, here 90°, and utilizing the same $\alpha$ and $R_o$, the other side edge of the antenna element can be developed. By shifting 180° out of phase, that is, utilizing a starting reference line on the opposite side of the center point 180° from the original reference line, the second antenna element can be constructed utilizing the same formula and same parameters.

Figure 3:
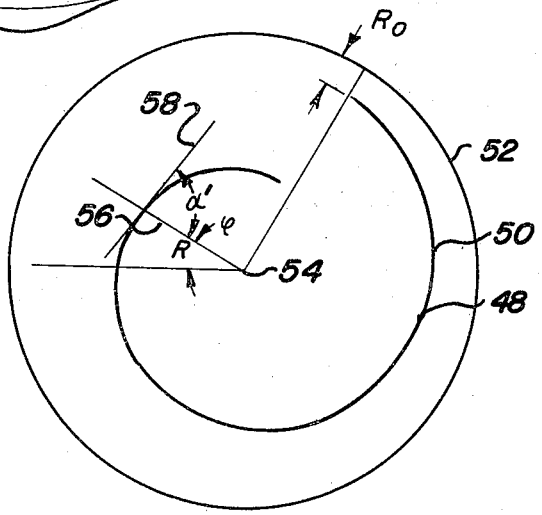
FIG. 3 is a schematic diagram of an inverse logarithmic curve.

Similarly, referring to FIG. 3, a diagram of an inverse logarithmic curve 50 is shown to illustrate schematically the parameters of the basic inverse logarithmic equation: $R = R_n - R_o \exp[-(\cot\alpha)\phi]$ utilized to construct the inverse logarithmic poriton of the antenna circuit of FIG. 1. In FIG. 3, only one edge line 48 of one antenna element is shown for purposes of clarity. The other edge line and other element may be developed in a manner as described with reference to FIG. 2. In FIG. 3, $R_n$ is a theoretical starting radius 52, equivalent to the center point 44 in the prior equation. $R_o$ is an incremental radial distance from $R_n$ for starting the inverse curve and again is for the purpose of allowing the curve to be fabricated in practice since the curve lines would theoretically be infinitely close together at $R_n$. R is again the radial line 56 from the center point 54 to the locus of the curve 50. $\alpha'$ is the wrap angle formed by the radial line and a tangent line 58 at a locus point on the curve 50. The equation of the tangent of the inverse logarithmic spiral is:

$$\alpha' = \tan^{-1} \frac{R\tan\alpha}{R_n - R}.$$

To construct an antenna circuit having both a logarithmic spiral and a coupled inverse logarithmic spiral, the equations are matched at some select radius from the center point. The $\phi$ of the inverse equasion is adjusted to a reference line at the junction of the two spirals.

Depending on particular design considerations, $\alpha$ may be identical for both equations or different; $R_o$ may be the same or different and $R_n$ may be selected with regard to the radius at which the log pattern is ended and the inverse log pattern begun, and with regard to the ultimate size of the antenna and necessary length needed for an effective termination.

Other more complex variations may be made, such as the suggested change in $\alpha$ at certain radial distances or by utilizing two reference center points for each of the two antenna elements. Such variations do not depart from the teachings of this disclosure.

Figure 4:
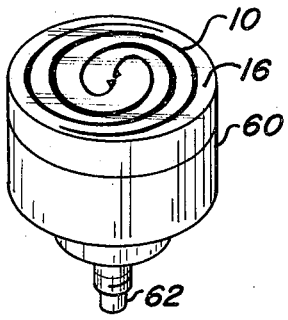
FIG. 4 is a perspective view of the spiral antenna circuit on an antenna support structure.

Referring now to FIG. 4, a specific application of the antenna circuit is shown. The antenna circuit 10, supported on a thin dielectric blank 16 is mounted to a hollow support base 60. A preferred method of mounting is described in greater detail in issued U.S. Pat. No. 3,781,898. A coaxial cable connector 62 at the bottom of the base 60 provides a connection to a balun circuit (not shown) for emitting or receiving signals from the antenna circuit. Balun leads (not shown) within the support base 60 connect the cable connector 62 to each antenna element, 12 and 14, of the antenna circuit 10. For practical use, the antenna circuit 10 is covered by a thin impervious dielectric cover (not shown) to protect the pattern from the environment.

The antenna circuit of this invention, as noted, may be constructed in various configurations without departing from the teachings of this disclosure and the definition of the claim.

What is claimed is:

1. A spiral antenna circuit comprising first and second antenna elements, each having at least one continuously scaled logarithmic spiral having a width continuously growing and at least one continuously scaled inverse logarithmic spiral having a termination with a termination point and having a width continuously diminishing to said termination point, wherein the inverse logarithmic spiral has an in continuum coupling to the logarithmic spiral; said continuously scaled logarithmic spiral being constructed from logarithmic equations and said continuously scaled inverse logarithmic spiral being constructed from inverse logarithmic equations.

2. In an antenna having continuously scaled spiral logarithmic antenna circuit elements constructed from logarithmic equations, a termination comprising continuously scaled spiral inverse logarithmic circuit elements constructed from inverse logarithmic equations, said inverse logarithmic circuit elements having an in continuum coupling to said logarithmic circuit elements.

3. A spiral antenna circuit comprising at least one continuously scaled logarithmic spiral element spiraling substantially from a center point to a predetermined first radius from the center point, said logarithmic spiral element being constructed from logarithmic equations and having a circuit termination comprising at least one continuously scaled inverse logarithmic spiral element coupled to said logarithmic spiral element at the first radius and terminating at a predetermined second radius incrementally distant from the first radius, said inverse logarithmic spiral element being constructed from inverse logarithmic equations.

4. The spiral antenna circuit of claim 3 wherein said continuously scaled logarithmic spiral element includes a plurality of continuously scaled, coupled, logarithmic spirals having different wrap angles.

5. The spiral antenna circuit of claim 3 wherein said continuously scaled inverse logarithmic spiral element includes a plurality of continuously scaled, coupled, inverse logarithmic spirals having different wrap angles.

6. The spiral antenna circuit of claim 3 wherein said circuit has two continuously scaled logarithmic spiral elements spiraling 180° out of phase substantially from said center point with each of said elements having a circuit termination comprising continuously scaled inverse logarithmic spiral element.

7. The spiral circuit of claim 3 wherein said circuit has a multiplicity of spiral elements spiraling 360/° out of phase, where $n$ is the number of elements, from said center point with each of said elements having a circuit termination comprising a continuously scaled inverse logarithmic spiral element.

8. The spiral antenna circuit of claim 1 wherein said antenna elements are constructed on a common surface.

* * * * *